US010415108B2

(12) United States Patent
Belchior

(10) Patent No.: US 10,415,108 B2
(45) Date of Patent: Sep. 17, 2019

(54) STEEL ALLOY FOR RAILWAY COMPONENTS, AND PROCESS OF MANUFACTURING A STEEL ALLOY FOR RAILWAY COMPONENTS

(71) Applicant: Amsted Maxion Fundicao e Equipamentos Ferroviarios S.A., Cruzeiro (BR)

(72) Inventor: Carlos Marcelo Belchior, Cruzeiro (BR)

(73) Assignee: Amsted Maxion Fundição e Equipamentos Ferroviários S.A., Cruzeiro-SP (BR)

( * ) Notice: Subject to any disclaimer, the term of this patent is extended or adjusted under 35 U.S.C. 154(b) by 93 days.

(21) Appl. No.: 15/406,307

(22) Filed: Jan. 13, 2017

(65) Prior Publication Data

US 2017/0204487 A1 Jul. 20, 2017

(30) Foreign Application Priority Data

Jan. 18, 2016 (BR) ..... 02016001063

(51) Int. Cl.

| | |
|---|---|
| ***C21D 1/18*** | (2006.01) |
| ***C21D 6/00*** | (2006.01) |
| ***B22D 25/02*** | (2006.01) |
| ***C22C 38/00*** | (2006.01) |
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/50*** | (2006.01) |

(52) U.S. Cl.

CPC ..... *C21D 1/18* (2013.01); *B22D 25/02* (2013.01); *C21D 6/004* (2013.01); *C21D 6/005* (2013.01); *C21D 6/008* (2013.01); *C22C 38/002* (2013.01); *C22C 38/02* (2013.01); *C22C 38/04* (2013.01); *C22C 38/06* (2013.01); *C22C 38/42* (2013.01); *C22C 38/44* (2013.01); *C22C 38/50* (2013.01); *C21D 2211/001* (2013.01); *C21D 2211/002* (2013.01); *C21D 2211/008* (2013.01)

(58) Field of Classification Search

CPC ..... C21D 1/18; C21D 6/004; C21D 6/005; C21D 6/008; B22D 25/02; C22C 38/002; C22C 38/02; C22C 38/04; C22C 38/06; C22C 38/42; C22C 38/44; C22C 38/50

See application file for complete search history.

(56) References Cited

U.S. PATENT DOCUMENTS 2,447,089 A 8/1948 Payson
2,853,410 A 9/1958 Lula et al.
(Continued)

*Primary Examiner* — Cam N. Nguyen
(74) *Attorney, Agent, or Firm* — Alston & Bird LLP

(57) ABSTRACT

The present invention relates to the steel alloy for railway components and the process of manufacturing it, said alloy comprising, in weight percentage, from 0.21 to 0.27 carbon, from 0.80 to 1.20 manganese, from 0.35 to 0.60 silicon, up to 0.02 phosphorus, up to 0.02 sulfur, from 0.55 to 0.65 chromium, from 0.45 to 0.55 molybdenum, from 1.75 to 2.05 nickel and from 0.005 to 0.030 titanium, conferring, with its composition, desirable mechanical properties, hardenability and corrosion resistance for application on railway components.

7 Claims, 7 Drawing Sheets

(56) References Cited

U.S. PATENT DOCUMENTS 3,899,368 A * 8/1975 Waid ..... C22C 38/42 148/328
4,157,258 A * 6/1979 Philip ..... C22C 38/44 148/319
5,482,675 A 1/1996 Shotwell et al.
6,045,630 A * 4/2000 Fujiwara ..... C21D 8/0205 148/336
6,183,573 B1 * 2/2001 Fujiwara ..... C21D 8/0205 148/336
6,572,713 B2 * 6/2003 Kucharczyk ..... C22C 38/001 148/329
6,869,692 B2 * 3/2005 Pacher ..... B23D 61/127 148/335
6,899,774 B2 * 5/2005 Takayama ..... C21D 9/22 148/320
7,160,399 B2 1/2007 Kuehmann et al.
7,235,212 B2 6/2007 Kuehmann et al.
7,601,231 B2 * 10/2009 Hara ..... C21D 8/0226 148/330
7,708,841 B2 * 5/2010 Saller ..... C22C 38/58 148/327
7,718,014 B2 * 5/2010 Usami ..... B23K 35/3053 148/332
7,731,896 B2 * 6/2010 Usami ..... B23K 35/3053 420/119
7,879,160 B2 * 2/2011 Sun ..... C22C 38/002 148/330
7,935,303 B2 * 5/2011 Nakashima ..... C21C 7/0006 420/105
7,959,747 B2 * 6/2011 Sun ..... C22C 38/002 148/533
7,967,927 B2 6/2011 Kuehmann et al.
8,002,910 B2 * 8/2011 Tivelli ..... C21D 1/18 148/335
8,114,227 B2 * 2/2012 Corquillet ..... C21D 1/185 148/647
8,317,946 B2 * 11/2012 Arai ..... C21D 8/10 148/335
8,337,643 B2 * 12/2012 Sun ..... C22C 38/002 148/332
8,337,749 B2 * 12/2012 Bergstrom ..... C22C 38/42 420/56
8,414,715 B2 4/2013 Altschuler et al.
8,454,765 B2 * 6/2013 Saller ..... C22C 38/58 148/327
8,540,933 B2 * 9/2013 Nylof ..... C22C 38/001 148/325
8,580,050 B2 * 11/2013 Morita ..... C22C 38/001 148/316
8,636,856 B2 1/2014 Altschuler et al.
8,911,567 B2 * 12/2014 Ogawa ..... C21D 8/0426 148/330
8,974,612 B2 * 3/2015 Takasawa ..... C21D 1/28 148/330
9,188,252 B2 * 11/2015 Altschuler ..... C21D 1/25
9,222,156 B2 12/2015 Altschuler et al.
9,273,382 B2 * 3/2016 Mizutani ..... B23K 1/0014
9,340,847 B2 * 5/2016 Altschuler ..... C21D 8/0236
9,624,563 B2 * 4/2017 Mizutani ..... B01J 35/04
9,822,435 B2 * 11/2017 Bergstrom ..... C22C 38/42
9,856,551 B2 * 1/2018 Alfonsson ..... C22C 38/42
9,869,009 B2 * 1/2018 Vartanov ..... C22C 38/50
9,879,334 B2 * 1/2018 Ueda ..... C22C 38/02
9,938,599 B2 * 4/2018 Ueda ..... C22C 38/00
2010/0043925 A1 * 2/2010 Sun ..... C22C 38/002 148/330
2010/0192895 A1 * 8/2010 Pelsoeczy ..... C22C 38/08 123/193.2
2010/0319814 A1 12/2010 Perez et al.
2011/0182765 A1 * 7/2011 Giefers ..... C21D 1/673 420/112
2011/0259478 A1 * 10/2011 Schneider ..... C22C 38/02 148/332
2011/0316522 A1 * 12/2011 Shinobu ..... G01N 5/02 324/109
2012/0000336 A1 * 1/2012 Schremb ..... C21D 1/06 83/694
2012/0138194 A1 * 6/2012 Sun ..... B32B 15/013 148/400
2013/0078031 A1 * 3/2013 Nakamura ..... B23K 35/0255 403/272
2015/0047749 A1 * 2/2015 Hirata ..... C21D 9/08 148/330
2016/0184935 A1 * 6/2016 Sjodin ..... B23K 35/3066 165/166
2016/0281197 A1 9/2016 Ortolani et al.
2016/0305192 A1 10/2016 Buher et al.

* cited by examiner

STEEL ALLOY FOR RAILWAY COMPONENTS, AND PROCESS OF MANUFACTURING A STEEL ALLOY FOR RAILWAY COMPONENTS

CROSS-REFERENCE TO RELATED APPLICATIONS

This application claims priority to and the benefit of Brazilian Application No. BR102016001063-2, filed Jan. 18, 2016, the contents of which as are hereby incorporated by reference in their entirety.

BACKGROUND

Technical Field

The present invention relates to a steel alloy, more specifically for application on railway components, which chemical composition promotes the enhancement of many of its mechanical properties, more particularly fatigue strength.

Description of Related Art

In the last few years, rail shipping has considerably increased due to a growing demand for high capacity transport. This demand has created a need to increase the volume of goods being carried in a train, which has led to an increase in the number of railway freight cars. Moreover, railway freight cars have been designed to have bigger capacity.

As the volume of goods being carried in a train has increased, so has the need for mechanical railway components. The most required components include shock and traction systems, responsible for the safe coupling of the locomotive with the carriages.

Besides safe operation, flexibility, standardization and easy operation are vital features of the said systems. They must ensure the quick coupling and uncoupling of the cars as well as transfer the traction and compression effort along the train, within established limits.

After simulations are run and data on the instrumented cars analyzed, it was noticed that the shock and traction systems of the current railway cars are being subjected to extreme longitudinal effort, which substantially increases the risk of failure and increases preventive and corrective maintenance costs.

Naturally, one of the problems arising from the increase in the volume of goods being carried in a train is that the alloy utilized to produce the components of the shock and traction system of each car is no longer suitable for that.

More specifically, the composition of the steel alloys that are commonly utilized to manufacture railway car components do not favor the condition of extreme longitudinal effort the shock and traction system undergoes. An example is the alloy disclosed by U.S. Pat. No. 2,447,089, which has high tensile and impact strength and is suitable for railway and automotive industries.

The chemical composition of the alloy disclosed by U.S. Pat. No. 2,447,089 is 0.15-0.4% carbon, 1.0-2.5% manganese, 0.8-3.0% silicon, 1.0-5.0% nickel and 0.25-1.0% molybdenum. Although the abovementioned ranges are useful for imparting various beneficial mechanical characteristics to components of the railway composition, the chemical composition causes several problems that render it currently inappropriate for use, like the absence of titanium, which works as a grain size refiner and reduces the harmful effects of nitrogen, and the lack of the specification of maximum phosphorus and sulfur levels, which are vital elements to all the mechanical properties desirable in a shock and traction system. Furthermore, manganese is in a range "too high" for hardened and tempered steel and may compromise the said alloy's toughness.

Another alloy known in the art and that exhibits mechanical capacity issues is the one disclosed by U.S. Pat. No. 5,482,675. Such alloy—as reported by the said document—is specific for railway cars and has the following chemical composition: from 0.15 to 0.21% carbon, from 0.9 to 1.3% manganese, from 0.35 to 0.65% silicon, from 0.25 to 0.6% chromium, from 0.1 to 0.3% molybdenum, up to 0.025% phosphorus and up to 0.025% sulfur. However, once again titanium was not utilized, and the maximum phosphorus and sulfur levels are way too high for the current standard, thereby compromising certain desirable features, like toughness, for example. Nickel, which improves toughness and synergistically works with chromium and molybdenum, is lacking too.

Therefore, a steel alloy suitable for railway car components—more specifically for components of the railway car shock and traction system—, which promotes enough mechanical properties to endure the effort the cars are subjected to with the current cargo demand, is not known in the art.

BRIEF SUMMARY

A first objective of the present invention is to provide a steel alloy, more specifically low alloy steel for railway components, which mechanical properties are suitable for the rail freight transport's growing cargo demand, while remaining economically feasible and commercially relevant.

A second objective of the present invention is to provide a steel alloy for railway car shock and traction systems, which fatigue strength is suitable for the rail freight transport's growing cargo demand.

A third objective of the present invention is to provide a steel alloy for railway car shock and traction systems, having good corrosion resistance, especially atmospheric corrosion, while accomplishing all the cited objectives.

A fourth objective of the present invention is to provide a steel alloy for railway car shock and traction systems, which chemical compositions allows for good hardenability and avoids tempering fragility.

A fifth objective of the present invention is to provide a process of manufacturing the present alloy which allows it to reach the proposed objectives as efficient as possible.

The present invention relates to a steel alloy for railway components which comprises, in weight percentage, from 0.21 to 0.27 carbon, from 0.80 to 1.20 manganese, from 0.35 to 0.60 silicon, up to 0.02 phosphorus, up to 0.02 sulfur, from 0.55 to 0.65 chromium, from 0.45 to 0.55 molybdenum, from 1.75 to 2.05 nickel and from 0.005 to 0.030 titanium.

Particularly, the alloy also comprises, in weight percentage, up to 0.30 copper and from 0.020 to 0.050 aluminum. Equilibrium is basically iron and impurities.

The process of producing the abovementioned steel alloy comprises the following steps: Step i) casting the alloy; Step ii) normalizing; Step iii) heat treating; and Step iv) tempering.

In step iv) tempering is carried out at 400-700° C. for 1-5 hours. In step ii) normalizing is carried out at 910° C. for 2 hours and 15 minutes, cooling is carried out at room temperature, and in step ii) heat treating is carried out at 900° C. for 2 hours and 15 minutes, cooling is carried out at a maximum temperature of 38° C.

More particularly, in step iv) tempering may be carried out at 530-600° C. for 2-4 hours and even more particularly at 560° C. for 3 hours.

Also, between steps i) and ii)—casting and normalizing—there may be an intermediate step: forging.

BRIEF DESCRIPTION OF THE FIGURES

Below, the present invention will be thoroughly described based on an embodiment example displayed in the figures. The figures show.

DETAILED DESCRIPTION OF VARIOUS EMBODIMENTS

Figure 1:
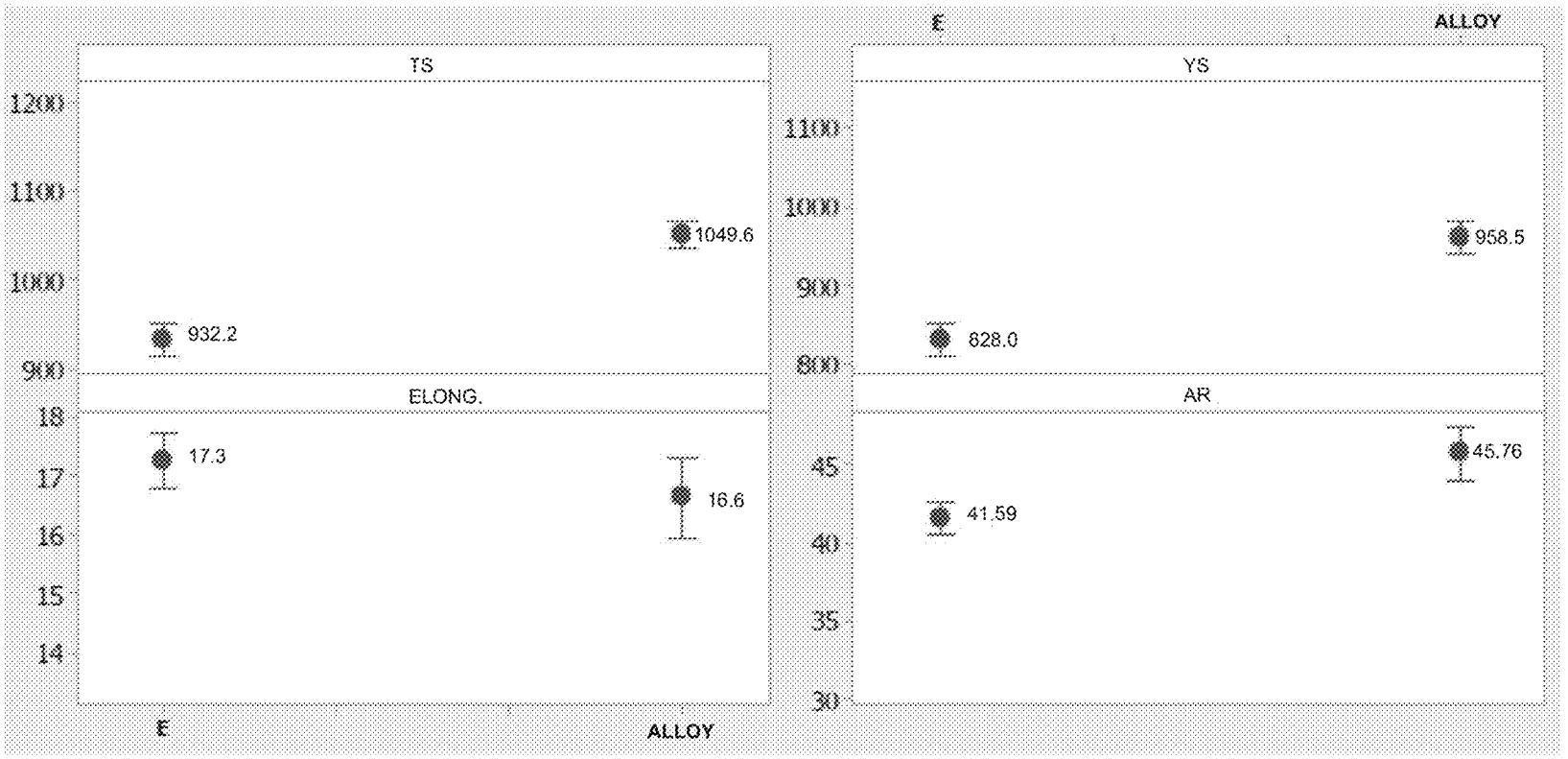
FIG. 1—a set of plots showing the results of tensile strength tests on the alloy of the claimed invention compared with those of a standard "E" grade steel.

The steel alloy of the claimed invention aims at exhibiting better mechanical properties—especially those relative to fatigue strength—than those of the alloys usually employed in railway components by including and altering the concentration of certain chemical elements present therein.

First it is worth saying that an increase in the carbon content may extend the steel's fatigue strength, but other alloying elements may be necessary to achieve the required hardenability. Since the increase in the carbon content may also bring on a series of drawbacks (lower ductility, for example), a better approach consists in selecting a steel having the lowest possible carbon content combined with the required quantity of alloying elements to impart to a tempered martensite structure the necessary resistance to attain a desirable fatigue strength.

Bearing in mind that such premise is the basis of the studies on and development of the alloy of the claimed invention—and after successive tests on different alloys and thermal treatments—, the ideal alloy was obtained, an alloy that fulfills the needs of the present invention, with the following chemical composition range:

| | | Element | | | | | | | | | | |
|---|---|---|---|---|---|---|---|---|---|---|---|---|
| | | C | Mn | Si | P | S | Cr | Mo | Ni | Cu | Al | Ti |
| Comp. | Min. | 0.21 | 0.80 | 0.35 | — | — | 0.55 | 0.45 | 1.75 | — | 0.020 | 0.005 |
| % | Max. | 0.27 | 1.20 | 0.60 | 0.02 | 0.02 | 0.65 | 0.55 | 2.05 | 0.30 | 0.050 | 0.030 |

It will be explained now how such a specific alloy was obtained, and tests confirming the efficiency thereof in relation to the alloys known in the art useful in railway car shock and traction systems will be presented.

First, it is worth saying that the steel alloy of the claimed invention is regarded as "low alloy", i.e., the content of alloying elements other than iron and carbon in a total weight percentage of up to 8%, approximately. Low alloy steel is the most commonly utilized to produce the elements of the railway car shock and traction systems, and it is even recommended by the Association of American Railroads (AAR).

More specifically, the AAR's Safety and Operations department's "Manual of Standards and Recommended Practices" contains all the standards, specifications and practices recommended by the Association of American Railroads. Section S, part I ("Casting Details") thereof provides casting details and the specifications for coupling systems. Specification M-201 in particular relates to cast carbon steel and low alloy for locomotives and train cars utilizing the so-called A, B, B+, C, D and E grades. Many components of the shock and traction system are cast at the E grade, which must be hardened and tempered.

The table below displays the alloying requirements the E grade steel must satisfy:

| Element | C | Mn | Si | P | S |
|---|---|---|---|---|---|
| Max. % | 0.32 | 1.85 | 1.50 | 0.04 | 0.04 |

The content of elements other than those displayed by the table above must be selected by the manufacturer in order to achieve the specified mechanical properties. Moreover, the Carbon Equivalent (CE) of the alloy must be no higher than 0.88%, calculated according to the following formula:

$$CE = C + \frac{Mn + Si}{6} + \frac{Cr + Mo + V}{5} + \frac{Ni + Cu}{15}$$

As it can be seen, the chemical composition of the alloy of the present invention meets the requirements imposed on an E grade steel.

As informed before, the development of the present invention aimed to preserve the lowest possible carbon content with the necessary quantity of other alloying elements to yield a resistant and economically feasible structure. Thus, the composition was assessed in order to refine the concentration of each element that is part of the alloy, considering both their contribution to the desired properties and their economic characteristics. In addition, reduction in the vulnerability to the formation of heat treating (quenching) cracks was pursued.

Below are the elements that form the alloy and their concentration.

1. Elements of the Composition

Manganese: It exerts a strong effect on the steel's hardenability, and therefore is extremely relevant to reach good mechanical properties. It shows smaller tendency to macrosegregate than any of the common elements.

Manganese is beneficial to surface quality after thermal treatment and also contributes to the hardness and resistance of the steel, although less than carbon does. In fact, its contribution depends upon the carbon content, which is directly proportional.

Despite its advantages concerning hardness and resistance, the increase in manganese content reduces the ductility and weldability of the steel obtained. Furthermore, in martensitic steel (hardened and tempered ones), the presence of manganese reduces toughness. For such reason the content of manganese in the alloy of the present invention is notably different from the maximum content set down by the AAR for E grade steel.

Silicon: A minimal quantity of silicon is required to provide fluidity in casting and pouring operations in cast steel. It is one of the main deoxidants employed in the production of steel and, therefore, the quantity thereof depends upon the type of steel produced.

Thus, if silicon is employed in deoxidization (i.e., silicon-killed steel), coarse austenitic grain is obtained. In the event aluminum is employed in the deoxidization (i.e., aluminum-killed steel), fine austenitic grain is obtained. An explanation for the production of fine grains is that at the austenitization temperature for thermal treatment, aluminum combines with the nitrogen dissolved in the steel to form aluminum nitrides. The aluminum nitride particles inhibit the growth of the austenite grains.

Hence, as to steel having the same chemical composition, microstructure and resistance, the "alumimum-killed, fine-grained" ones will exhibit greater toughness than the "silicon-killed, coarse-grained" ones. Therefore, a minimal quantity of silicon is utilized in the chemical composition of the alloy of the claimed invention.

Phosphorus: The increase in the concentration of phosphorus in a steel alloy increases the said alloy's resistance and hardness and reduces its ductility and toughness. Such a reduction is lower in high carbon steel; however, it is not the case of the alloy of the present invention, which aims at keeping carbon content as low as possible. Thus, the phosphorus content in the alloy of the present invention is the lowest possible—also to incur reasonable production costs—but, in general, the longer the dephosphorization step, the more expensive the process.

Sulfur: Sulfur is found in the alloy of the present invention mostly as impurity, since it hardly provides any benefit to the mechanical properties of the alloy. Similarly to phosphorus, the sulfur content is defined by the lowest possible one—also to incur reasonable production costs—but, in general, the longer the desulfurization step, the more expensive the process.

Sulfur is seriously detrimental to the surface quality of steel, more particularly low carbon steel and low managenese steel, which is the case of the claimed invention. A higher sulfur content reduces transversal ductility and toughness, and provides only a minor benefit to the longitudinal mechanical properties. It has greater tendency to segregate than any of the other common elements, and is associated, together with phosphorus, with the formation of contraction cracks in cast steel. Weldability also drops as the sulfur content rises.

Its harmful influence on the properties of the alloy is slightly attenuated by providing the steel with such a manganese content that the sulfide that is predominantly formed is the manganese sulfide, less detrimental than iron sulfide. Thus, the minimum sulfur concentration in the alloy of the present invention is justified and so is the managenese concentration selected.

Chromium: Besides increasing hardenability and high temperature resistance, chromium is also added to steel to increase corrosion resistance and oxidation resistance. Chromium is also employed as a hardener and usually employed together with an element to increase toughness, just like nickel, to yield superior mechanical properties.

Nickel, combined with chromium, produces steel with improved hardenability, superior impact resistance and higher fatigue strength than carbon steel, and therefore an appropriate level was utilized in the alloy of the present invention to achieve such properties.

Molybdenum: When molybdenum is in solid solution in austenite before heat treating, the reaction rates for transformation are considerably slower than those of the carbon steel. Molybdenum may induce secondary hardening during tempering of hardened steel and increases creep resistance of low alloy steel at high temperatures. Plus, adding molybdenum to chromium-nickel steel significantly improves hardenability and renders the alloy relatively immune to tempering fragility and, therefore, a proper level was utilized in the alloy of the present invention to achieve such properties.

Nickel: Nickel-containing steel can be easily thermally treated because nickel reduces critical cooling rate. Combined with chromium, nickel produces steel with improved hardenability, superior impact resistance and higher fatigue strength than carbon steel, and therefore an appropriate level was utilized in the alloy of the present invention to achieve such properties.

Copper: At considerable concentrations, copper impairs hot working operations. Copper is detrimental to surface quality and aggravates the surface defects inherent in resulfurized steel. Nonetheless, copper is beneficial to atmospheric corrosion resistance when present at concentrations over 0.20%, which justifies the maximum concentration established for the alloy of the present invention.

Aluminum: As explained as to the use of silicon, of all the alloying elements aluminum is the most effective in controlling the growth of grains before heat treating. When added to steel in specified amounts, aluminum can control the growth of austenitic grains in reheated steel.

More specifically, at the austenitization temperature for thermal treatment, aluminum combines with the nitrogen dissolved in the steel to form aluminum nitrides. The aluminum nitride particles inhibit the growth of the austenite grains and, therefore, aluminum is necessary in the claimed alloy.

Titanium: Depending on the concentration of titanium in the alloy, it works as a grain size refiner and protects the final product from the detrimental effect of aluminum nitride formation by preferably forming titanium nitride which, besides refining the grain size, disperses into fine particles, thereby increasing the steel's resistance. Hence, the present alloy makes use of titanium to achieve such effects.

Thus, the composition of the alloy of the present invention contains the abovementioned elements at concentrations that allow for perfect harmony of its properties, thus resulting in a low alloy steel with high fatigue strength and all other desirable mechanical resistances.

2. Computer-Aided Estimate for the Mechanical Properties

During the development of the alloy of the present invention, it was considered that it was important to collect previous information on the mechanical properties expected from real tests and assays and information on the potential advantages to be achieved over the alloys known in the art.

To get to said information, computer-aided assays were carried out with software SteCal 3.0® to simulate the manufacture of the alloy of the claimed invention. Such software anticipates mechanical properties obtained from a certain thermal treatment applied to low alloy steel, and calculates the parameters and properties that represent the said steel's behavior based on the most effective and precise calculation routines available.

In said tests, a composition which alloy values are in the middle of the range defined for the present invention was utilized.

The initial values were defined from a minimum value established after taking into account the minimum concentration that meets the requirements of the contribution of each chemical element. Then, the average and maximum values were defined, considering the slightest variability possible to be maintained (capability of the inner physicochemical process), as well as occasional technical (or economical) problems arising from an excessively high maximum limit. The intermediate alloy is as follows:

| | Element | | | | | | | | |
|---|---|---|---|---|---|---|---|---|---|
| | C | Mn | Si | P | S | Cr | Mo | Ni | Al |
| Comp % | 0.240 | 1.000 | 0.475 | 0.017 | 0.017 | 0.600 | 0.500 | 1.900 | 0.035 |

Other input data utilized in the test:
ASTM 6 grain size;
cooling means: water;
tempering time: 3 h.
Below are the results of the computer-aided tests:

| Hardening Tempering<br>Complete hardening: Hq = Hm = 46.0 HRC<br>Elapsed time: 3 h | | | | | |
|---|---|---|---|---|---|
| T<br>C | HRC | HV<br>MPa | UTS<br>MPa | YS<br>% | EL |
| 400 | 38.0 | 370 | 1190 | 1000 | 10 |
| 425 | 36.5 | 355 | 1130 | 950 | 11 |
| 450 | 36.0 | 345 | 1080 | 890 | 12 |
| 475 | 36.0 | 350 | 1110 | 920 | 11 |
| 500 | 35.5 | 345 | 1100 | 910 | 12 |
| 525 | 34.5 | 340 | 1070 | 860 | 12 |
| 550 | 33.5 | 335 | 1050 | 860 | 13 |
| 575 | 33.0 | 325 | 1020 | 830 | 13 |
| 600 | 32.0 | 315 | 990 | 800 | 14 |
| 625 | 30.0 | 300 | 950 | 750 | 15 |
| 650 | 28.0 | 390 | 900 | 710 | 16 |
| 675 | 26.0 | 275 | 860 | 670 | 17 |
| 700 | 24.0 | 260 | 830 | 630 | 17 |

In the table above, the first column contains "T" and "C", which indicate the tempering temperatures tested, in degrees Celsius. The interval tested ranges from 400° C. to 700° C.

The second and third columns show the results for hardness on the Rockwell scale (HRC) and the Vickers scale (HV), respectively. The fourth column shows the results for ultimate tensile strength in Megapascal (UTS, MPa), the fifth column shows the yield strength, also in Megapascal (YS, MPa), and the sixth one the elongation percentage value (EL, %).

From the computer-aided test, thermal treatment parameters were also obtained, according to the table below:

| Thermal Treatment Data<br>General data: | |
|---|---|
| Lower critical temperature: | A1 = 708 C. |
| Critical heating points: | |
| Lowest: | Ac1 = 708 C. |
| Highest: | Ac3 = 794 C. |
| Highest possible temperature: | 696 C. |
| Austenitization temperature: | 685 C. |
| Retained austenite at 20° C.: | 2% |
| Susceptibility to breaking upon heat treating: | low/null |
| Available hardess after heat treating: | |
| Structure containing 99% martensite: | Hm = 46.0 HRC |
| Structure containing 90% martensite: | HM90 = 42.5 HRC |
| Structure containing : 50% martensite | Hm60 = 34.5 HRC |
| Minimum recommended: | 42.5 HRC |
| Hardness as normalized (pearlitic structure): | 205 HV |
| Lowest hardness condition: (spheroidized structure): | 165 HV |

The computer-aided results are the parameter which defines what to be expected from real tests. They also provided the basis for real thermal treatment parameters, like austenitization temperature, for example (around 885° C.).

3. Casting and Forging

Before providing the explanations about the thermal treatments the alloy of the present invention is subjected to, it is worth expatiating upon the process of manufacturing the steel itself in its treatable geometry.

It is worth saying that steel comprising the alloy of the present invention can be obtained by casting and also by further forging, and steel obtained by both processes will equally benefit from the particular characteristics of the proposed alloy. This being said, casting is the most suitable process for obtaining complex geometries and that must be obtained in integral blocks, especially when there is internal complexity, such as the components of the railway car shock and traction system, while forging is the most suitable for obtaining parts having a simpler geometry.

Moreover, products made of cast steel do not exhibit the directionality effects in their mechanical properties, typical of forged steel. Said "non-directional" feature of the mechanical properties may be advantageous when the working conditions involve multidirectional loading.

Thus, the development and the tests carried out on the alloy of the present invention were based on cast steel, in order to reflect the results of an actual and marketable component of the shock and traction system.

4. Thermal Treatment

As it can be seen from the explanation about the composition of the alloy of the present invention, during the development of the present invention not only there was this concern to produce an alloy which provides a steel having good mechanical properties, but also having good hardenability, low tempering fragility, and lower tendency to cracking. Thus, the quality of the final product can be guaranteed not only by its composition, but also by the process of manufacturing it.

The vast majority of cast carbon steel, whether low or high alloy ones, manufactured today are thermally treated before being made available to service, in order to improve particular mechanical properties, corrosion resistance etc. The kind of treatment depends both on the alloy type and the intended working conditions.

In general, thermal treatment consists in heating to a high temperature followed by controlled cooling, aiming at obtaining particular microstructures and respective combinations of properties. The vital elements of any thermal treatment are heating cycle, soaking time and soaking temperature, and cooling cycle.

In the thermal treatment tests on the alloy of the present invention, exactly the same intermediate alloying composition utilized in the computer-aided tests was utilized, the additional chemical elements which form the final alloy being added, as follows:

| Element | | C | Mn | Si | P | S | Cr |
|---|---|---|---|---|---|---|---|
| Tested Range | Comp. % | 0.26578 | 0.99826 | 0.48045 | 0.01303 | 0.01661 | 0.58974 |
| | Min. | 0.21 | 0.80 | 0.35 | Max. | Max. | 0.55 |
| | Max. | 0.27 | 1.20 | 0.60 | 0.02 | 0.02 | 0.65 |

| Element | | Mo | Ni | Cu | Al | Ti |
|---|---|---|---|---|---|---|
| Tested Range | Comp. % | 0.52327 | 1.85631 | 0.04179 | 0.03027 | 0.02517 |
| | Min. | 0.45 | 1.75 | Max. | 0.02 | 0.01 |
| | Max. | 0.55 | 2.05 | 0.30 | 0.05 | 0.03 |

4.1. Normalizing

Normalizing is the thermal treatment aiming at homogenizing steel, followed by air cooling. The normalizing temperature depends on the concentration of carbon. Such treatment, specifically when it comes to the alloy of the present invention, aims to refine the structure of the grain and minimize carbon segregation which may have occurred during the solidification resulting from steel casting, dissolving secondary phases like carbides and yielding a homogeneous structure. After a time long enough for the alloy to completely turn into austenite, such treatment finishes with air cooling.

The steel containing the alloy of the claimed invention was normalized at 910° C. for 2 hours and 15 minutes, followed by cooling at room temperature.

4.2. Heat Treating

Heat treating is performed to increase the hardness of the treated steel. The part is austenitized at temperatures above the upper critical temperature and then quickly cooled to avoid the formation of ferrite and perlite. By hardening the steel by heat treating, it is possible to accelerate cooling from the austenitization temperature and control the transformation of austenite into bainite and martensite in order to reach greater strength and hardness.

After computer-aided simulations were run and practice tests were conducted, an ideal temperature of 900° C. for austenitization during a period of 2 hours and 15 minutes was defined, heat treating being performed with water at max. 38° C. With respect to that, it is worth saying that the simulation recommends at least 885° C. for austenitization, but one should bear in mind the time between withdrawal from the furnace and heat treating. In order to avoid that temperature fell to below 885° C. during the said transition, it was slightly raised to 900° C. It should also be noted that the temperature may vary according to the process' needs.

4.3. Tempering

Tempering is the process consisting in heating a hardened steel to a temperature below the lower critical temperature, in order to get it softened up, and then cooling it to room temperature. Tempering aims at reducing hardness and relieving some of the stress in order to get better ductility than that of the parts that underwent only heat treating.

Tempering alters martensite's structure and such an alteration can be employed to adjust strength, hardness, toughness and other mechanical properties to desired levels.

After successive tests at different temperatures and soaking times, a temperature range from 400° C. to 700° C., for 1 to 5 hours, was established to improve the mechanical characteristics of railway components of the shock and traction system in general, cooling being performed with water at max. 38° C. A particularly efficient example is a temperature of 560° C. for tempering for 3 hours, followed by cooling. In an alternative configuration, a temperature range from 530° C. to 600° C. for 2-4 hours is utilized.

After the optimal thermal treatment parameters were defined, test specimens were produced to carry out the mechanical and metallographic assays.

5. Mechanical and Metallographic Assays 5.1. Tensile strength Assays

Tensile strength assays were carried out utilizing a digitally-assisted Kratos equipment (SN 3.109), duly assessed, as per ASTM A370. The results obtained for the alloy of the present invention corresponding to tensile strength (MPa), yield strength (MPa), elongation (%) and area reduction (%) can be seen in FIG. 1, "ALLOY".

In order to better evince the improvements obtained from the development of the alloy of the present invention, assays were also conducted on a standard "E" grade steel, which results can be found in the same plot, under "E". It is also worth saying that all the results for the alloy of the present invention yielded by the tensile strength assay met the AAR-M201 specifications/requirements.

5.2. Charpy Impact Test

Figure 2:
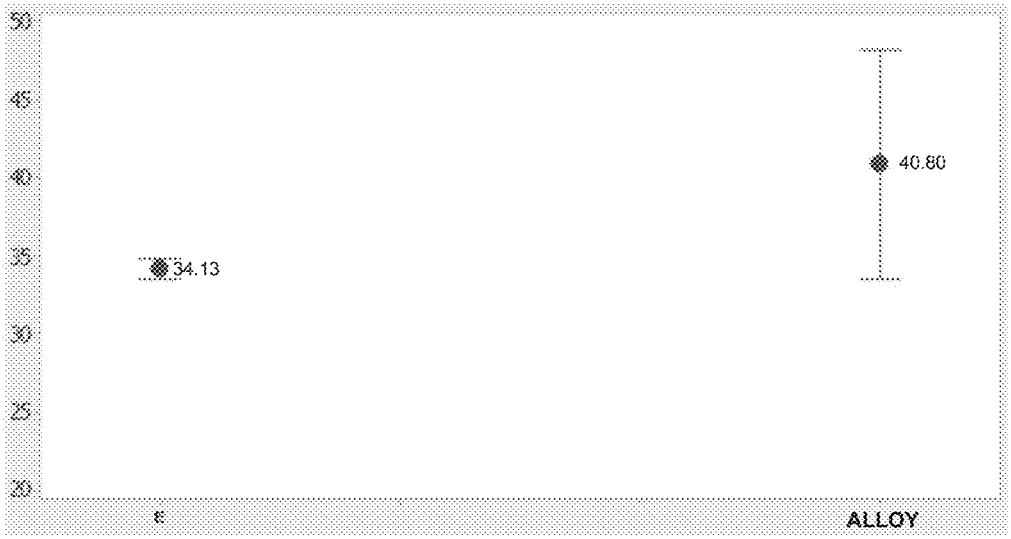
FIG. 2—a plot showing the results for impact tests on the alloy of the claimed invention compared with a standard "E" grade steel.

Charpy V-notch tests were carried out utilizing a Heckert equipment (SN 33304), duly assessed, as per ASTM E-23, for a sample temperature of −40° C. The results can be seen in FIG. 2 (energy values measured in Joule). Once again, the results obtained with the alloy of the present invention ("ALLOY") were compared with those of the standard "E" grade steel.

As it can be seen, toughness has increased and reached an average value of 40.8 J, which is not only according to the AAR requirements, but also quite better than them.

5.3. Hardness Assays

Figure 3:
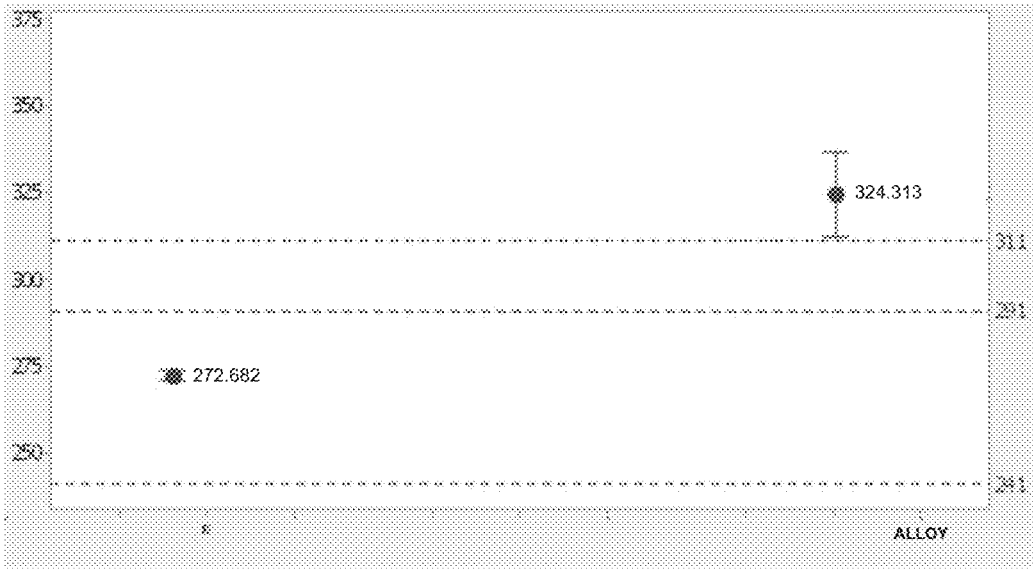
FIG. 3—a plot showing the results for hardness tests on the alloy of the claimed invention compared with a standard "E" grade steel.

Hardness assays were carried out in accordance with the Brinell method, as per ASTM A370, with the aid of a portable Duromak hardness tester (Marktest). The results can be seen in FIG. 3, accompanied by the results obtained for a standard E grade steel.

As it can be seen, the alloy of the present invention extrapolates its corresponding maximum limits as established by the AAR for certain components of the railway car shock and traction system (311 HB for couplers and braces, and 291 HB for jaws).

The values for hardness increased significantly, following the increase in tensile strength and yield strength. It should also be noted that, since both ductility and toughness were kept within acceptable limits (assessed by means of the tensile strength assay), the higher hardness values are not taken as a problem, but rather as a positive aspect of this new material.

5.4. Metallographic Tests

The micrographic analyses were conducted with a digitally-assisted Olympus microscope (GX51). The results obtained from the samples attacked with nital at 2% and 5%, magnified at 500×, are displayed in FIG. 2.

The austenitic grain size was measured according to ASTM E-112, attacked with Picral, oxidized at 885° C. for 30 m, and magnified at 500×.

Figure 4:
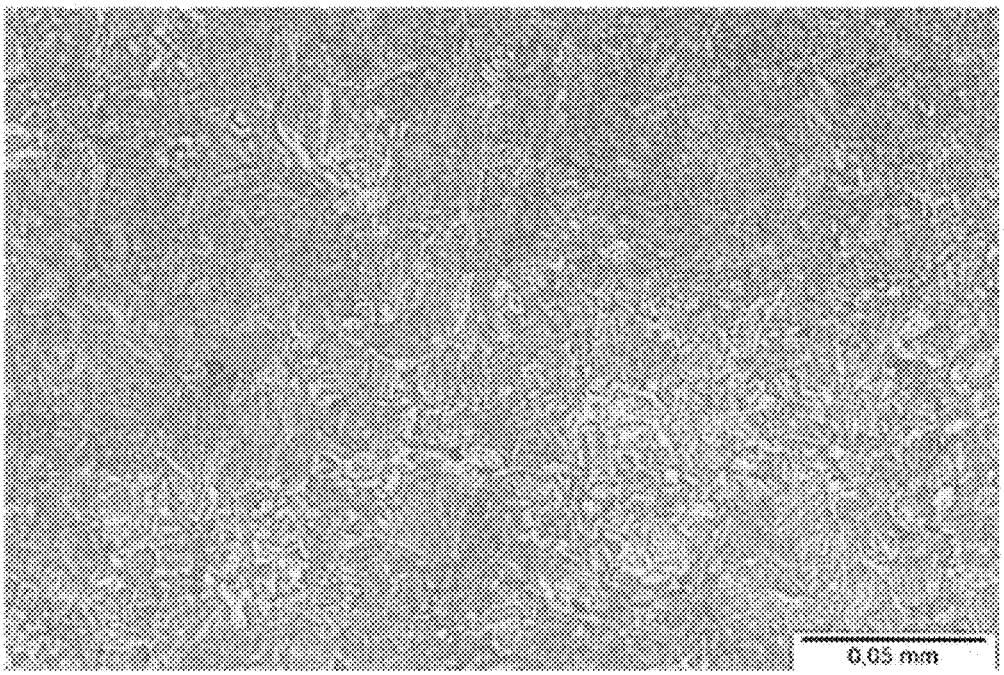
FIG. 4—typical microstructure of a standard "E" grade steel.
Figure 5:
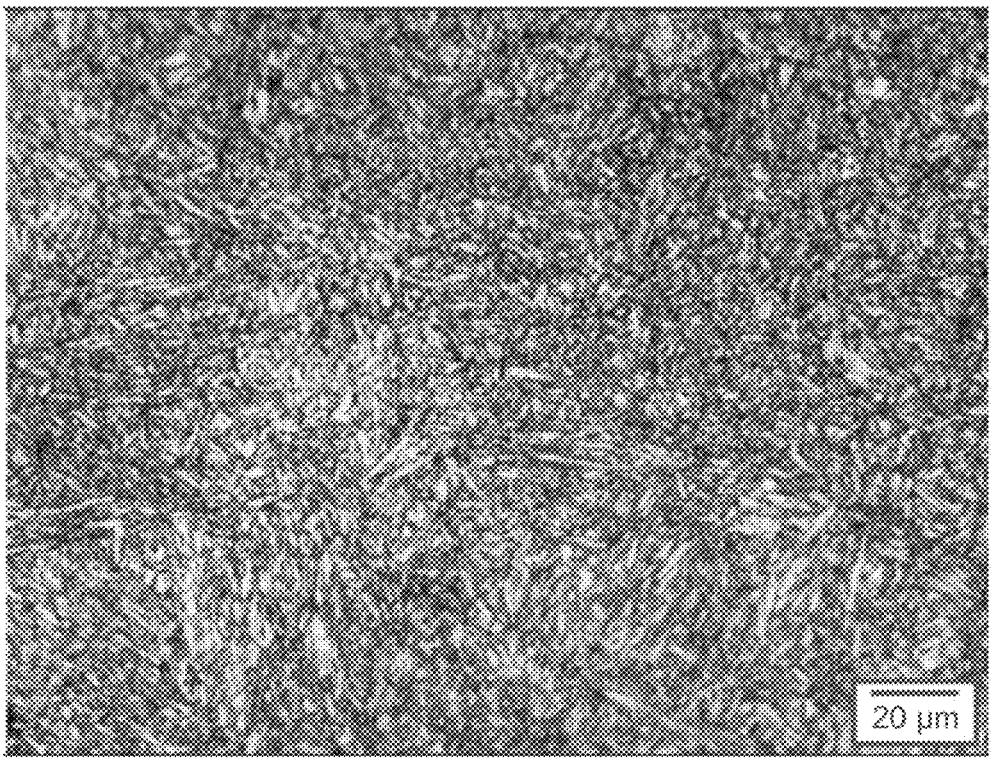
FIG. 5—typical microstructure of the steel comprising the alloy of the present invention.

The typical microstructures of a standard "E" grade steel can be seen in FIG. 4, while those of the alloy of the present invention are found in FIG. 5.

The structure of the composition of the alloy of the present invention is totally tempered martensite, differently from the standard E grade steel, which also comprises acicular ferrite. It evinces the greater hardenability of the new compositions subjected to testing.

Figure 7:
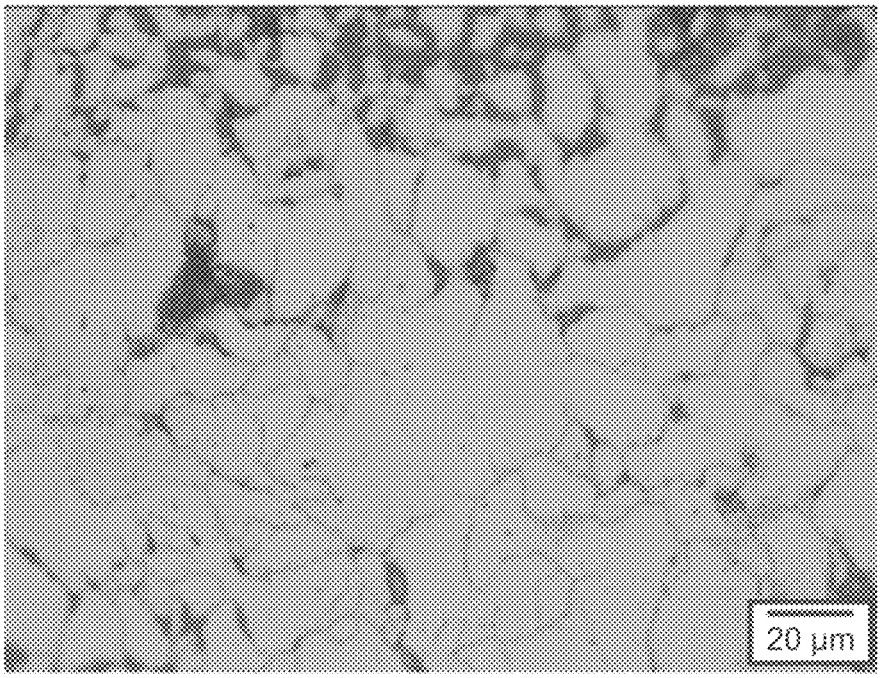
FIG. 7—austenitic grain size of the steel comprising the alloy of the claimed invention.

The austenitic grain size was also measured according to ASTM E-112, and ranges between 10 and 11 ASTM, in compliance with the so-called "fine grain practice", i.e., steel produced in the FEA and deoxidized with aluminum, as it can be seen in FIG. 7 and the table below, corresponding to the alloy of the present invention.

| | Fields | | | | | |
|---|---|---|---|---|---|---|
| | 1 | 2 | 3 | 4 | 5 | Average |
| Results | 11.5 | 9.5 | 10.5 | 9.5 | 10.0 | 10.0 |

Figure 6:
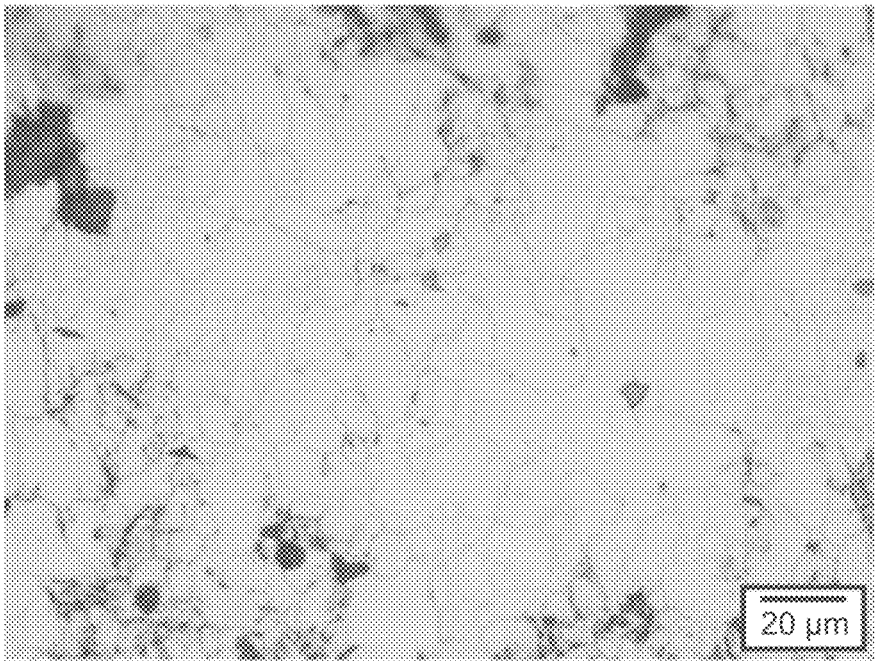
FIG. 6—austenitic grain size of a standard "E" grade steel.

On the other hand, FIG. 6 displays the austenitic grain size of a standard "E" grade steel, and the table below shows the grain size corresponding to such kind of steel.

| | Fields | | | | | |
|---|---|---|---|---|---|---|
| | 1 | 2 | 3 | 4 | 5 | Average |
| Results | 11.0 | 11.5 | 10.5 | 11.5 | 11.5 | 11.0 |

It is also worth saying that the austenitic grain size is more refined than the value utilized in the computer-aided simulations (ASTM 6). Thus, the actual mechanical properties are superior to those predicted by simulation, benefited from a greater grain refining.

5.5. Magnetic Particle Inspection (Non-Destructive Testing)

Magnetic particle inspection is carried out on highly stressed cast steel for detecting surface and subsurface discontinuities. It consists in putting a magnetic field into the part, and said field, when discontinuities are found, allows the magnetic flux to leak, being mobilized to the surface and producing areas of leakage. Magnetic fluorescing particles will build up at the areas of leakage and form an indication on the surface of the part, which can then be easily mapped.

The magnetic particle inspection made in this project, as per ASTM E 709, utilized a Fluxotec equipment provided with electrodes (also known as pointed probes) which make electric current pass through the test part by touching the surface thereof. The magnetic field created is circle-like, where the lines of force pass through the part in a closed circuit loop. It is employed to detect longitudinal discontinuities.

Figure 8:
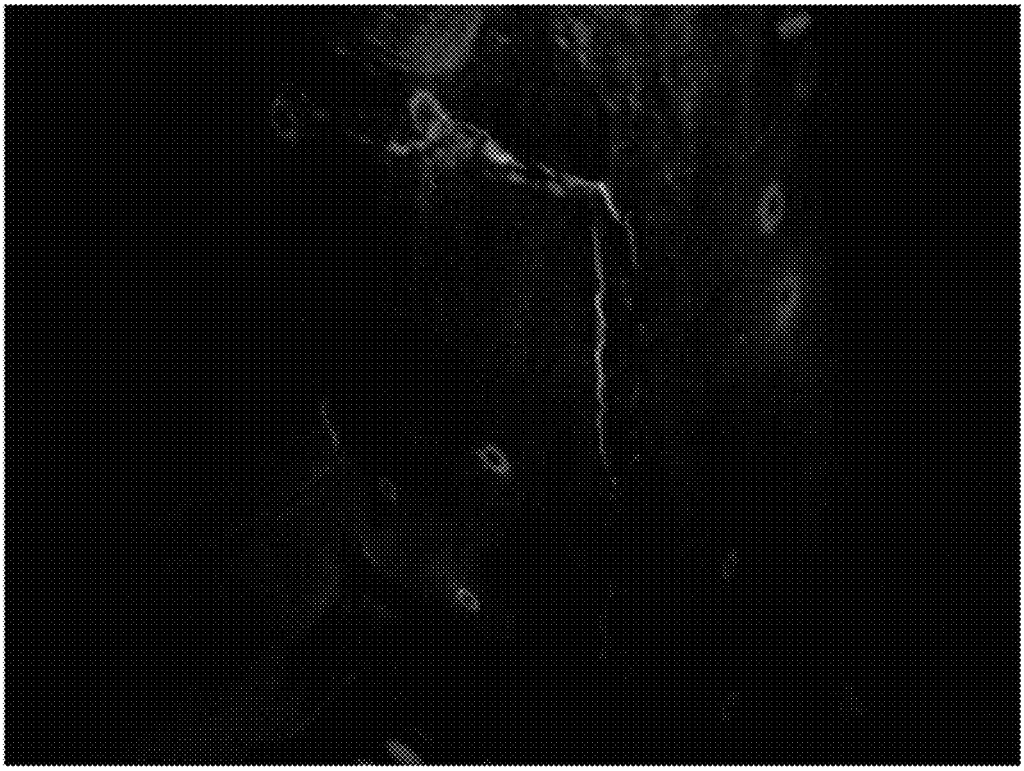
FIG. 8—discontinuity revealed by magnetic particle inspection carried out on a mechanical part comprising a standard "E" grade steel.
Figure 9:
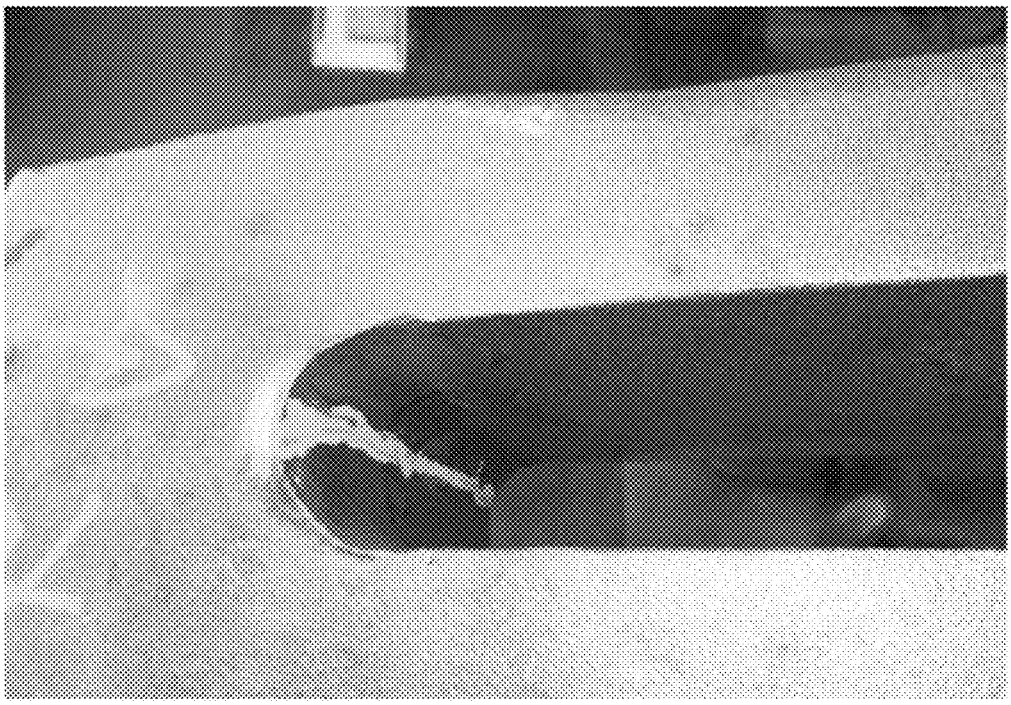
FIG. 9—discontinuity revealed by magnetic particle inspection carried out on a mechanical part comprising a standard "E" grade steel.

The magnetic fluorescing particles applied are wet ones. FIGS. 8 and 9 show discontinuity revealed during the magnetic particle inspection with fluorescing particles, and a crack at the rear of one of the railway couplings subjected to testing, both made of standard E grade steel, respectively.

The magnetic particle inspection was also carried out on a steel containing the alloy of the present invention, and it yielded superior results respective to cracking susceptibility during thermal treatment; improvement in the hardenability was also noticed.

Figure 12:
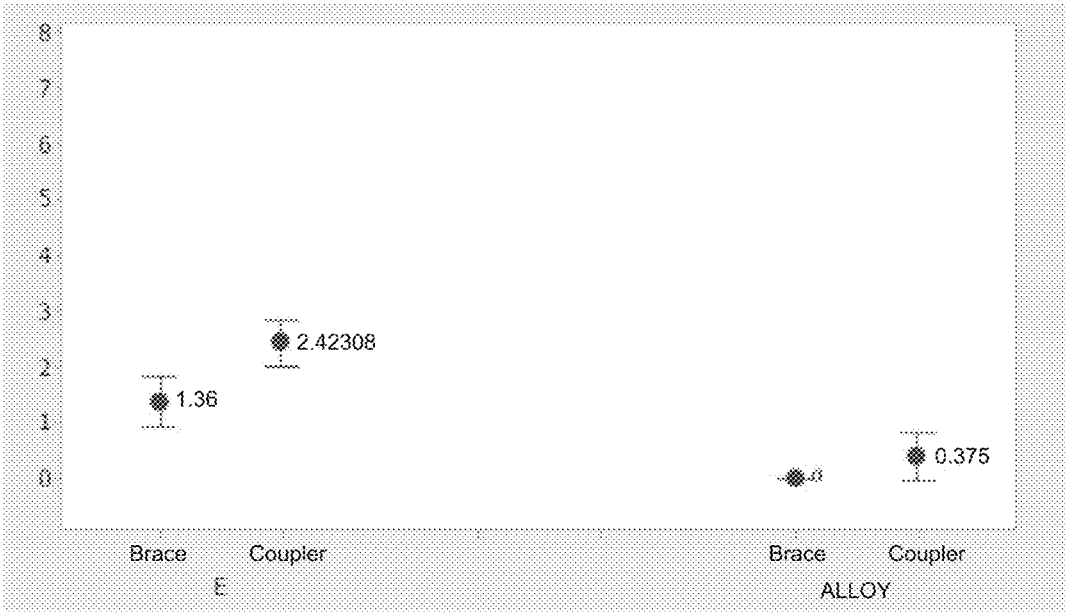
FIG. 12—plot displaying the average amount of discontinuities in a steel comprising the alloy of the claimed invention in relation to a standard "E" grade steel.
Figure 13:
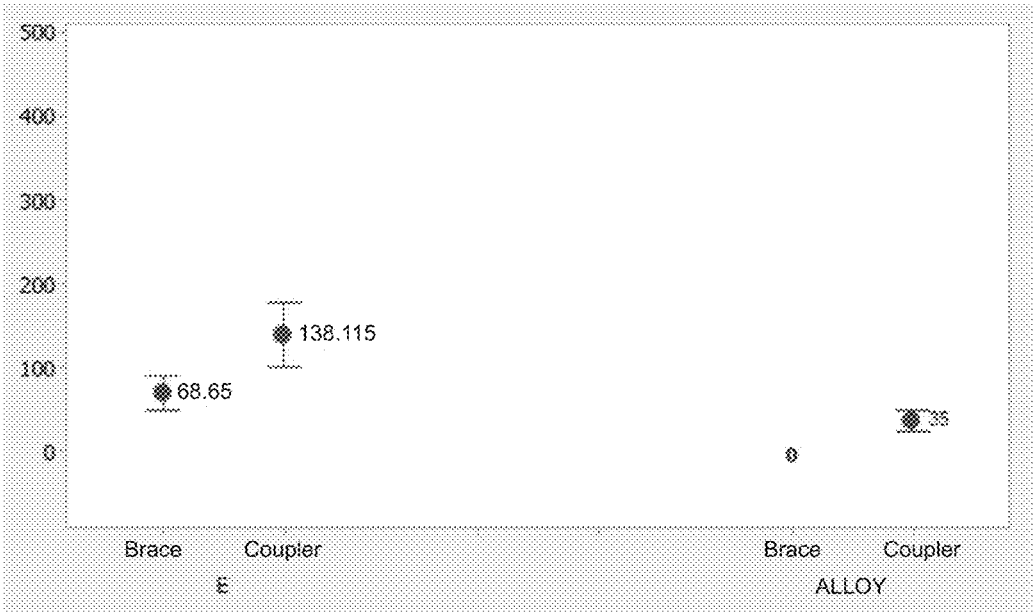
FIG. 13—plot displaying the total average length of discontinuities in a steel comprising the alloy of the claimed invention in relation to a standard "E" grade steel.

FIG. 12 depicts the result of the test relative to the average amount of discontinuities conducted on the alloy of the present invention in comparison with an E grade steel, for railway braces and couplings. FIG. 13 shows the values of the total average length of discontinuities in the test of FIG. 12 (in mm). As it can be seen, the alloy of the present invention provides superior properties to steel in such aspect.

5.6. Rotary Bending Fatigue Testing

Since fatigue strength is one of the most desired properties in the alloy of the present invention, fatigue tests were carried out both on the standard E grade steel and the alloy of the present invention, for comparison of results.

The tests were conducted with a RBF-200 model Fatigue Dynamics equipment (FIG. 3.43) under fully reversed loading conditions (R=−1), on 20 test specimens made of standard E grade steel and 20 test specimens made of the alloy steel of the present invention, as per ASTM E466-07.

Testing begins with a test specimen being subjected to cyclical stress, under a relatively high maximum stress amplitude (usually ⅔ of the tensile strength), and the number of cycles (Nf) till failure is counted.

Said procedure is carried out on all the test specimens, wherein successively lower maximum stress amplitudes (Sa) are employed, till fatigue limit is detected, below which fatigue failure will not occur. Values equal to or higher than $10^7$ cycles were regarded as having "infinite fatigue life", where tests were interrupted without sample failure.

Data was then entered pursuant to ASTM E739-10, with a "Y=A+BX" type linear model, wherein "Y" is the logarithm of the number of reversals (2Nf, i.e., twice the number of cycles), and "X" is the logarithm of the maximum stress amplitude (Sa).

Traditionally, data on fatigue behavior obtained with said testing is entered as a function of the cyclical stress applied. It results in the so-called S-N curve.

The test results for the standard E grade steel can be seen in the table below:

| M (Ib · pol) | M (N · mm) | Sa (MPa) | Frequency (Hz) | Test # | T. Speci-men # | Nf |
|---|---|---|---|---|---|---|
| 34 | 3842 | 589 | 46 | 1 | 11 | 21200 |
| 34 | 3842 | 589 | 46 | 3 | 7 | 28600 |
| 34 | 3842 | 589 | 46 | 4 | 10 | 29500 |
| 29 | 3277 | 502 | 44 | 2 | 3 | 79600 |
| 29 | 3277 | 502 | 46 | 5 | 18 | 172000 |
| 29 | 3277 | 502 | 46 | 6 | 8 | 104700 |
| 24 | 2712 | 416 | 46 | 7 | 12 | 299700 |
| 24 | 2712 | 416 | 46 | 10 | 2 | 728300 |
| 24 | 2712 | 416 | 46 | 11 | 17 | 546200 |
| 23.5 | 2655.5 | 407 | 46 | 16 | 14 | 593400 |
| 23.5 | 2655.5 | 407 | 46 | 17 | 6 | 2003200 |
| 23.5 | 2655.5 | 407 | 46 | 18 | 16 | 357600 |
| 23.5 | 2655.5 | 407 | 46 | 19 | 20 | 715500 |
| 23 | 2599 | 398 | 30 | 13 | 4 | 10909100 |
| 23 | 2599 | 398 | 46 | 15 | 13 | 10374700 |
| 22 | 2486 | 381 | 30 | 14 | 15 | 10028200 |
| 21 | 2373 | 364 | 46 | 8 | 9 | 10113500 |

The test results for the steel containing the alloy of the present invention can be seen in the table below:

| M (Ib · pol) | M (N · mm) | Sa (MPa) | Frequency (Hz) | Test # | T. Speci-men # | Nf |
|---|---|---|---|---|---|---|
| 39 | 4407 | 676 | 40 | 12 | 12 | 18200 |
| 39 | 4407 | 676 | 40 | 13 | 13 | 43500 |
| 39 | 4407 | 676 | 40 | 14 | 14 | 56800 |
| 34 | 3842 | 589 | 40 | 1 | 1 | 62900 |
| 34 | 3842 | 589 | 40 | 2 | 2 | 82200 |
| 34 | 3842 | 589 | 40 | 11 | 11 | 213500 |
| 29 | 3277 | 502 | 40 | 4 | 4 | 305400 |
| 29 | 3277 | 502 | 40 | 5 | 5 | 1093600 |
| 29 | 3277 | 502 | 40 | 6 | 6 | 2506900 |
| 27 | 3051 | 468 | 40 | 8 | 8 | 8977700 |
| 27 | 3051 | 468 | 40 | 10 | 10 | 9035300 |

Figure 10:
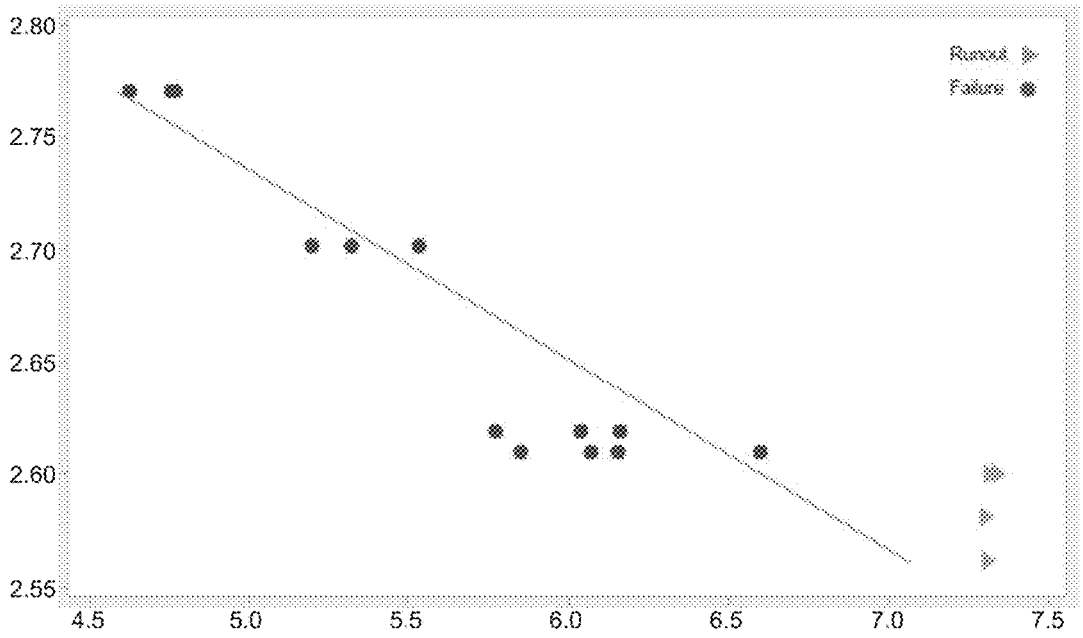
FIG. 10—plot displaying the S-N curve of a standard "E" grade steel.
Figure 11:
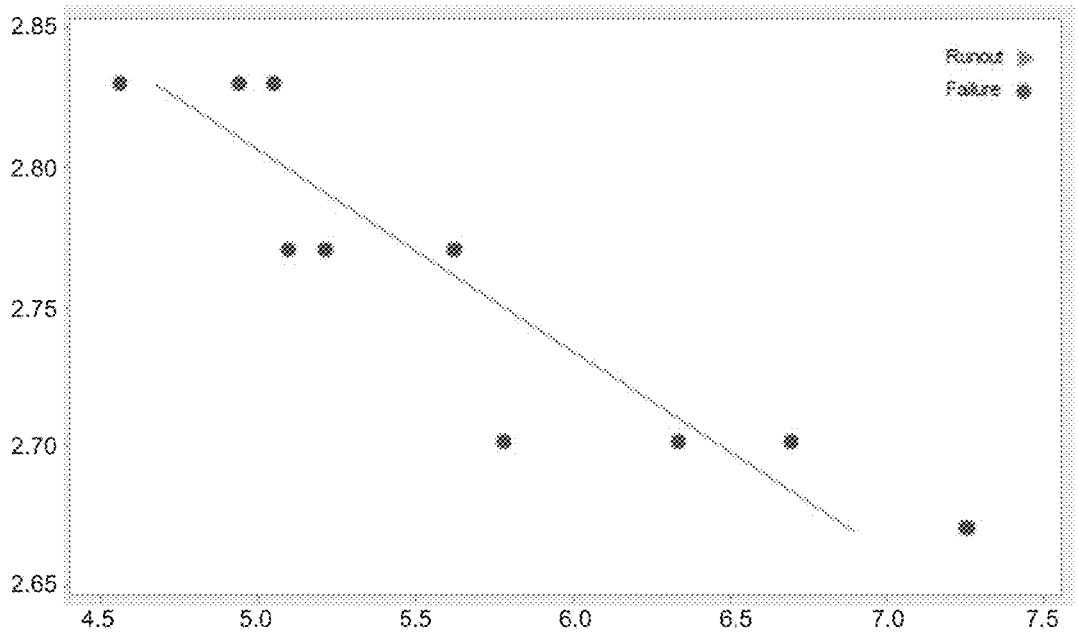
FIG. 11—plot displaying the S-N curve of a steel comprising the alloy of the claimed invention.

The plot of the curves of the E grade steel and the steel containing the alloy of the present invention are displayed by FIGS. 10 and 11, respectively, the abcissa being the logarithm of the number of reversals (2Nf), and the ordinate being the logarithm of the maximum stress amplitude (Sa), the "runout" points being the fatigue limit and the "failure" points being the points where failure occurs.

From the S-N obtained, the curve corresponding to the steel containing the alloy of the present invention can be clearly seen rightwardly respective to the E grade steel, as well as a rise in the fatigue strength. It was concluded that the behavior of the alloy of the present invention is superior to that of standard E grade steel.

According to the tests conducted on the alloy of the present invention, it is clear that the present alloy, besides meeting all the requirements as recommended by the AAR, exhibits better indexes than many of them. All the conducted tests reflect the superiority of the alloy of the present invention over the standard "E" grade steel; thus, the alloy in question presented significant advantages over the one known in the art. More specifically, it can be noticed that the objective concerning improving fatigue strength of the present invention was accomplished.

Furthermore, the alloy of the present invention has ideal concentrations of elements for enhancing hardenability and corrosion resistance which cannot be found in the alloys known in the art.

Whereas a preferred example of embodiment was herein described, it must be understood that the scope of the present invention encompasses other possible variations, being limited only by the content of the appended claims, including the possible equivalents.

The invention claimed is:

1. A steel alloy for railway components, said alloy consisting of, in weight percentage, from 0.21 to 0.27 carbon, from 0.80 to 1.20 manganese, from 0.35 to 0.60 silicon, up to 0.02 phosphorus, up to 0.02 sulfur, from 0.55 to 0.65 chromium, from 0.45 to 0.55 molybdenum, from 1.75 to 2.05 nickel, from 0.005 to 0.030 titanium, at least one of: (a) up to 0.30 copper, or (b) from 0.020 to 0.050 aluminum, and a balance of iron and impurities.

2. The alloy according to claim 1, consisting of, in weight percentage, 1.00 manganese.

3. The alloy according to claim 1, consisting of, in weight percentage, 0.48 silicon.

4. The alloy according to claim 1, consisting of, in weight percentage, 0.013 phosphorus.

5. The alloy according to claim 1, consisting of, in weight percentage, 0.59 chromium.

6. The alloy according to claim 1, consisting of, in weight percentage, from 0.35 to 0.39 silicon.

7. The alloy according to claim 1, consisting of, in weight percentage, 0.04 copper and 0.03 aluminum.

* * * * *